United States Patent [19]

Erbstoesser

[11] 4,187,909

[45] Feb. 12, 1980

[54] METHOD AND APPARATUS FOR PLACING BUOYANT BALL SEALERS

[75] Inventor: Steven R. Erbstoesser, Houston, Tex.

[73] Assignee: Exxon Production Research Company, Houston, Tex.

[21] Appl. No.: 852,173

[22] Filed: Nov. 16, 1977

[51] Int. Cl.[2] ..... E21B 33/10; E21B 33/13

[52] U.S. Cl. ..... 166/284; 166/285; 166/292; 137/268

[58] Field of Search ..... 166/69, 99, 107, 162, 166/165, 228, 230, 279, 284, 285, 292; 175/54, 58, 60, 72, 309, 312, 380, 236, 243, 254, 246–249; 137/268; 294/68, 86.11

[56] References Cited

U.S. PATENT DOCUMENTS

| | | | |
|---|---|---|---|
| 2,139,929 | 12/1938 | Blow | 175/309 X |
| 2,754,910 | 7/1956 | Derrick et al. | 166/284 |
| 2,933,136 | 4/1960 | Ayers et al. | 166/284 |
| 3,011,548 | 12/1961 | Holt | 166/284 |
| 3,086,587 | 4/1963 | Zandmer et al. | 166/72 X |
| 3,123,157 | 3/1964 | Graham | 175/58 |
| 3,174,546 | 3/1965 | Flickinger | 166/284 |
| 3,292,700 | 12/1966 | Berry | 166/284 |
| 3,376,934 | 4/1968 | Willman et al. | 166/193 |
| 3,437,147 | 4/1969 | Davies | 166/305 |
| 3,547,197 | 12/1970 | Chevalier et al. | 166/284 |
| 3,595,314 | 7/1971 | Garner | 166/192 |
| 3,715,055 | 3/1973 | Kendrick et al. | 221/75 |
| 3,895,678 | 7/1975 | Wright et al. | 166/284 |
| 4,084,636 | 4/1978 | Burge | 166/99 X |

OTHER PUBLICATIONS

Brown et al., "Stimulation Treatment Selectivity Through Perforation Ball Sealer Technology", The Petroleum Engineer, Jun. 1959.

Permeator Corp. (Canada) Ltd., "Permeator Well Completion Operator's Manual", Revised Sep. 1967, copyright 1964.

Neill et al., "An Inexpensive Method of Multiple Fracturing", Drilling and Production Practice, API, 1958, pp. 27–32.

Howard, "Ball Sealers in Fracturing and Acidizing", Canadian Oil and Gas Industries, Jan. 1962, pp. 43–46.

*Primary Examiner*—Ernest R. Purser

*Assistant Examiner*—Nick A. Nichols, Jr.

*Attorney, Agent, or Firm*—Gary D. Lawson; Robert B. Martin

[57] ABSTRACT

A method and apparatus are described for diverting fluid when treating a subterranean formation penetrated by a well provided with casing having a plurality of perforations. Ball sealers having a density less than fluid in the casing are lowered down the casing between upper perforations and lower perforations. A screen means is positioned above the ball sealers to prevent upward migration of the balls to a level adjacent the upper perforations. A preferred screen means comprises a cage which is open at its lower end and has openings in its upper end which prevent passage of ball sealers therethrough and permits fluid flow down the casing and through the cage. The cage with the ball sealers therein is lowered down the casing by a conventional wireline. Once the cage and ball sealers are between the upper and lower perforations, a treating fluid more dense than the ball sealers is injected into the well to cause fluid flow. The treating fluid is caused to flow through the screen means to carry the ball sealers down the casing to plug the lower perforations while leaving the upper perforations open to fluid flow.

6 Claims, 1 Drawing Figure

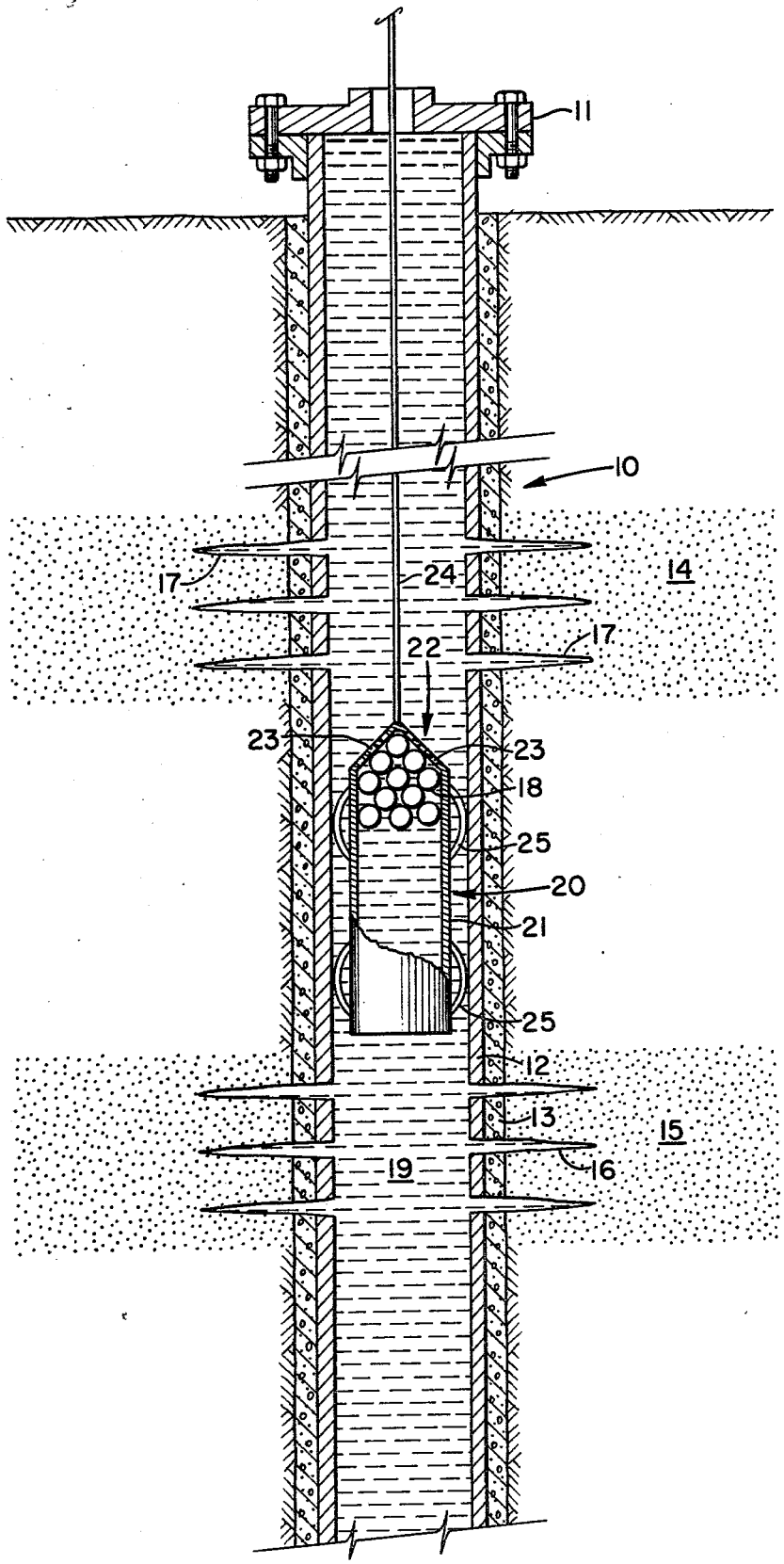
11
10
14
17
24
17
22
23
23
18
25
20
21
25
12
13
15
19
16

METHOD AND APPARATUS FOR PLACING BUOYANT BALL SEALERS

BACKGROUND OF THE INVENTION

1. Field of the Invention

This invention pertains to a method and apparatus for treating subterranean formations penetrated by a well. More particularly, the invention is directed to a method and apparatus by which certain portions of a perforated interval in a cased wellbore may be selectively plugged while treatment of other unplugged perforated intervals is enhanced.

2. Description of the Prior Art

It is common practice in completing oil and gas wells to set a string of pipe, known as casing, in the well and use cement around the outside of the casing to isolate the various hydrocarbon productive formations penetrated by the well. To establish fluid communication between the hydrocarbon bearing formations and the interior of the casing, the casing and cement sheath are perforated.

At various times during the life of the well, it may be desirable to increase the production rate of hydrocarbons by any of several means including acid treatment or hydraulic fracturing. If only a short, single hydrocarbon-bearing zone in the well has been perforated, the treating fluid will flow into this productive zone. As the length of the perforated zone or the number of perforated zones increases, treatment of the entire productive zone or zones becomes more difficult. For instance, the strata having the highest permeability will most likely consume the major portion of a given stimulation treatment leaving the least permeable strata virtually untreated. To overcome this problem, it has been proposed to divert the treating fluid from the high permeability zones to the low permeability zones.

Various techniques for selectively treating multiple zones have been suggested including techniques using packers, baffles and balls, bridge plugs, and ball sealers.

Packers have been used extensively for separating zones for treatment. Although these devices are effective, they are expensive to use because of the associated workover equipment required during the tubing-packer manipulations. Moreover, mechanical reliability tends to decrease as the depth of the well increases.

In using a baffle and ball to separate zones, a baffle ring, which fits between two joints of casing, has a slightly smaller inside diameter than the casing so that a large ball, or bomb, dropped in the casing will seat in the baffle. After the ball is seated in the baffle, the ball prevents further fluid flow down the hole. One disadvantage with this method is the extra expense of placing the baffle. Moreover, if two or more baffles are used the inside diameter of the bottom baffle may be so small that a standard perforating gun cannot be used to perforate below the bottom baffle.

A bridge plug, which is comprised principally of slips, a plug mandrel, and a rubber sealing element, has also been run and set in casing to isolate one zone while treating another. After retracting or acidizing the well, the plug is generally retrieved or knocked to the well bottom with a chisel bailer. One difficulty with the bridge plug method is that the plug sometimes does not withstand high differential pressures. Another problem inherent to this diverting technique is that placement and removal of the plug can be expensive.

One of the more popular and widely used diverting techniques involves the use of ball sealers. In a typical method, ball sealers are pumped into the well along with formation treating fluid. The balls are carried down the wellbore and to the perforations by the fluid flow through the perforations. The balls seat upon the perforations and are held there by the pressure differential across the perforations.

Although ball sealer diverting techniques have met with considerable usage, the balls often do not perform effectively because only a fraction of the balls injected actually seat on perforations. Ball sealers having a density greater than the treating fluid will often yield a low and unpredictable seating efficiency highly dependent on the difference in density between the ball sealers and the fluid, the flow rate of the fluid through the perforations, and the number, spacing and orientation of the perforations. The net result is that the plugging of the desired number of perforations at the proper time during the treatment is left largely to chance. It is difficult to control which perforated interval of the perforated casing will receive the balls and in many instances results in undesired stimulation in some portions of the formation.

Ball sealers having a density less than the treating fluid have been proposed to improve this seating efficiency problem. The treating fluid containing lightweight ball sealers is injected down the well at a rate such that the downward velocity of the fluid is sufficient to impart a downward drag force on the ball sealers greater in magnitude than the upward buoyancy force of the ball sealers. Once the ball sealers have reached the perforations, they all will seat and plug the perforations and cause the treating fluid to be diverted to the remaining open perforations. One problem with using lightweight ball sealers is that if the downward flow of fluid in the casing is slow, which is generally the case with matrix acidizing treatments, the drag forces exerted on the balls by the treating fluid may not overcome the upward bouyancy force of the ball sealers and thus the ball sealers may not be transported to the perforations. Another problem is controlling which interval of the formation will be treated since lightweight balls carried down the casing by the treating fluid, often plug the upper perforations before plugging the lower perforations.

In recent years, various methods and types of apparatus have been devised for introducing into the well casing ball sealers appropriate to seat upon perforations formed in the casing. The following patents illustrate various apparatus for introducing balls into the casing: U.S. Pat. Nos. 2,754,910 to Derrick et al; 3,011,548 to Holt; and 3,292,700 to Berry. While the methods and apparatus disclosed in these patents have advantages over use of plugs and packers in permitting successive zones to be treated with treating fluids, a more positive means for controlling placement of the balls is desired for ball sealers having a density less than the treating fluid density.

SUMMARY OF THE INVENTION

The present invention provides a mechanical means for keeping ball sealers between an upper perforation and lower perforation in a cased wellbore using injection into the casing of a fluid which has a density greater than the ball sealer density. Broadly, the invention comprises introducing ball sealers into a perforated casing between an upper perforation and a lower perforation, lowering screen means to a position between the lower perforation and the upper perforation in a manner such that the ball sealers are disposed below the screen means and thereafter injecting a treating fluid downwardly into the casing through the upper perforation. The screen means is designed to prevent the balls from floating above the screen means and to permit fluid flow downwardly in the casing through the screen means to carry the ball sealers to perforations below the screen means. The screen means is preferably used to transport the balls down the casing. The fluid flowing downwardly through the screen means will carry the ball sealers to the perforations having fluid flow to seat the balls onto said perforations providing the flow rate of the treating fluid is sufficient to overcome the buoyancy of the balls.

The screen means can be any suitable device which will prevent the buoyant balls from floating upwardly to perforations above the screen means and to permit downward flow of fluids through the screen means.

Suitable devices to carry the balls downhole inside the screen means include degradable sacks or cannisters which would dissolve and release the balls; containment devices which would release balls by opening a port actuated by timed mechanisms, motion sensing mechanisms, or remotely controlled pyrotechnic devices, balls attached to degradable, soluble or pyrotechnic cords which would dissolve or be detonated; or combinations of these means. Alternatively, the balls can be located in the rathole utilizing any suitable means prior to establishing the screen means into the casing.

One embodiment of a suitable screen means for carrying out the invention comprises a basket, or cage, which is mechanically lowered to a position between the upper perforations and the lower perforations. The cage has a size to substantially fill the interior of the casing and is open at its lower end. A plurality of ball sealers designed to plug the lower perforations are disposed in said cage for downward discharge past the lower end of the cage during the treating operation. The cage has openings at its upper end for downward flow therethrough of a fluid flowing down the casing to transport ball sealers downwardly from the cage to the lower perforations.

The method and apparatus of the present invention provides positive placement of ball sealers having a density less than the density of the treating fluid heretofore unknown in well treatment operations.

BRIEF DESCRIPTION OF THE DRAWING

The FIGURE is an elevation view in section of a cased wellbore illustrating the method and apparatus of this invention. The FIGURE shows a ball sealer cage containing ball sealers positioned between upper and lower perforations in the casing.

DESCRIPTION OF THE PREFERRED EMBODIMENT

Referring to the FIGURE, a well 10 is shown having casing 12 run to the bottom of the wellbore. The well passes through an upper hydrocarbon productive interval 14 and a lower hydrocarbon interval 15. It is assumed for this example that the lower interval 15 has a higher permeability than the upper interval 14. The casing is shown being bonded to the sides of the borehole by cement 13 around the outside to hold the casing in place and to isolate intervals 14 and 15 penetrated by the well. The cement sheath 13 extends upward from the bottom of the well to the earth's surface. Interval 14 is in fluid communication with the interior of the casing 12 through perforations 17 and interval 15 is in fluid communication with the interior of the casing through perforations 16.

In the method and apparatus of this embodiment according to this invention, it is assumed that the well has been drilled, the casing run, cemented in place and perforated and a hydraulic stimulation treatment of productive zone 15 has been performed. Upon completion of the hydraulic treatment, such as acidizing, hydraulic fracturing or surfactant stimulation, perforations 16 in the casing should be sealed so that the upper perforations 17 can be selectively treated with a hydraulic treating fluid.

Hydraulic treatment of formation 14 is accomplished according to one embodiment of this invention by positioning ball sealers in the casing at a position between lower perforations 16 and upper perforations 17. The ball sealers have a size sufficient to close the lower perforations 16 and preferably have a density less than the density of the fluid in the well casing. The balls may be introduced in the casing by any suitable means. For example, the balls may be dropped into the casing from the wellhead or they may be positioned by a suitable mechanical device. In one embodiment described herein, the balls are disposed in a cage, identified generally in the FIGURE by numeral 20, and the cage is lowered in well casing 12 between perforations 16 and perforations 17. The cage is lowered from the casing head to the position shown in the drawings by any suitable means. One suitable means for positioning the cage in the wellbore may comprise a cable securely attached to the upper portion of the cage so that standard wireline techniques may be used to raise or lower the device in the wellbore. The lower portion 21 of the cage is cylindrical in form and has a diameter only slightly less than the interior diameter of the casing 12. The diameter of cage 20 should then be sufficiently close to the interior diameter of the casing to prevent upward passage of the ball sealers between the cage and the casing. The cage forms a chamber to carry the lightweight ball sealers which are sized to close perforations in the casing below the cage. The length of the cage may be extended to hold any number of balls depending on the number of perforations to be plugged. Affixed to the peripheral surface of the cage at spaced points are a plurality of bow springs 25 which are adapted to engage the inner surface of the casing for the purpose of guiding and centering the cage as it is being lowered from the well casing head to the position shown in the FIGURE. The top portion 22 of the cage is tapered and connected to wireline 24. Although not shown in the drawings, any latching means well known in the art may be positioned at the lower end of the wireline to disconnect the wireline from the cage when it is desired to leave the cage in the well. The cage 20 may be made of steel or steel alloy, plastic, aluminum, or other material capable of being drilled out, or dissolved by acid in the event it is desirable to leave the cage in the well. The top portion 22 has a plurality of openings 23 which have a diameter somewhat smaller than the diameter of the ball sealers 18 in the cage. Treating fluid injected downwardly in the casing flow through the cage via openings 23 and carry ball sealers 18 downwardly onto the level to the perforations 16 where they seat and divert the further injection of treating fluid through the open perforations 17.

Ball sealers used in the practice of this invention will not remain below the lowest perforation below the cage 20 through which the treating fluid is flowing. The wellbore fluid 19 has a density greater than the ball sealers density. Below the lowest perforations accepting fluid, the fluid in the wellbore remains stagnant; therefore, there is no downwardly directed drag force acting on the ball sealers to keep them below the lowest perforation taking the treating fluid. Hence, the upward buoyancy forces acting on the ball sealers will dominate in this interval.

By appropriate pumping means (not shown) at the surface of the well, the treating fluid is forced downwardly in the casing through openings 23 of the cage 20. The treating fluid will carry the ball sealers downwardly to the perforations below the cage which are receiving fluid provided the drag forces imposed on the ball sealer by the motion of the fluid shearing past the ball sealers is greater than the upward force of buoyancy acting on the ball sealers. If the downward velocity of the fluid is sufficient to carry the ball sealers downward, the fluid will carry the ball sealers to the perforations where they will seat and be held there by the pressure differential which exists across the perforation during injection.

By practicing the present invention, ball sealers will seat upon and plug the perforations through which fluid is flowing below cage 20 with 100% efficiency. Each and every ball sealer will seat and plug a perforation provided there is a perforation below the cage through which fluid is flowing and the flow of fluid down the casing through the cage 20 is sufficient to impart a downward drag force on each ball sealer greater in magnitude than the buoyancy force acting on that ball sealer.

When the treatment of interval 14 has been completed and the pressure differential relieved or reversed, the ball sealers will unseat from the perforations. Should the ball sealers have a density less than the density of the wellbore fluid at the termination of the treatment, the ball sealers will migrate upward and will be collected in cage 20.

The cage 20 may be removed from the well by withdrawing cable 24. Alternatively, the cage may be lowered to a position below at least some of the perforations 16 to prevent the production of ball sealers with formation fluids. Other perforations may also be selectively treated by advancing the cage to a position above the perforations to be selectively plugged and below the perforations which are to be left open for fluid flow and then again injecting treating fluid in the casing.

Various means may be used to carry ball sealers down the casing. Such means may include degradable sacks or cannisters (such as a water soluble bag material sold under the tradename POLYOX by Union Carbide) which would dissolve in the casing and release the balls; containment devices which would release balls by opening a port actuated by timed mechanisms, motion-sensing mechanisms, or remotely pyrotechnic devices; devices having ball sealers attached by degradable, soluble, or pyrotechnic cords which would dissolve or be detonated; or combinations of these means.

It will be appreciated that this invention permits any number of zones in a formation to be treated and that the sequence in which they are treated, i.e., top to bottom or vice versa, is immaterial.

It may be seen that the present invention possesses a number of advantages over conventional procedures used to deliver ball sealers having a density less than the treating fluid to a selected zone of perforated casing. With the process of the present invention, lightweight ball sealers can be positively positioned between upper perforations and lower perforations without using expensive equipment and without interfering with fluid flow through the upper perforations.

The principle of this invention and the best mode in which it is contemplated to apply that principle has been described. It is to be understood that the foregoing is illustrative only and that other apparatus and methods can be employed without departing from the true scope of the invention defined in the claims.

We claim:

1. A method of treating a formation penetrated by a well provided with casing having perforations at a plurality of levels wherein a ball sealer is used for restricting flow through a lower perforation while leaving an upper perforation open to fluid flow comprising lowering to a level between said upper perforation and said lower perforation a ball sealer having a size sufficient to plug the lower perforation and having a density less than the density of a treating fluid used in treating said formation;

lowering screen means between said upper perforation and said lower perforation and above said ball sealer adapted to keep said ball sealer below the screen means and to permit downward flow of fluid through said screen means to carry said ball sealer downward with said fluid; and injecting a treating fluid into the casing to cause fluid flow through said upper perforation and through said screen means to carry said ball sealer to said lower perforation.

2. The method as defined in claim 1 wherein the ball sealer is lowered into the casing with said screen means.

3. The method as defined in claim 1 further comprising lowering said screen means to a position below the lower perforations after injection of said treating fluid.

4. The method as defined in claim 1 wherein the ball sealer is lowered to said level in the casing in a water soluble bag.

5. A method of sealing lower perforations in the casing of a well while leaving upper perforations in the casing open to fluid flow comprising the steps of lowering a cage carrying a plurality of ball sealers having a size sufficient to plug said lower perforations to a position between the upper perforations and lower perforations and said cage being adapted to permit downward fluid flow therethrough; and, injecting a fluid having a density greater than the ball sealer density downwardly into the well through said upper perforations and through the cage with sufficient rate to carry the ball sealers down the casing and onto the lower perforation.

6. A method for treating a formation penetrated by a well provided with casing having a plurality of perforations wherein ball sealers selectively restrict flow through at least one of the perforations comprising placing a ball sealer between an upper perforation and a lower perfoation in the casing, placing a screen means below the upper perforation and above the ball sealer, said screen means keeping said ball sealer below the screen means and permitting downward flow of fluid in the casing to transport the ball sealer downwardly in the casing; and injecting a treating fuid into the casing at a sufficient rate to cause fluid to carry the ball sealer onto the lower perforation and to cause fluid flow through the upper perforation.

* * * * *